US005400571A

United States Patent [19]

Boriani et al.

[11] Patent Number: 5,400,571

[45] Date of Patent: Mar. 28, 1995

[54] METHOD AND MACHINE FOR PRODUCING CARTONS OF CIGARETTES

[75] Inventors: Silvano Boriani; Antonio Gamberini, both of Bologna, Italy

[73] Assignee: G.D Societa' per Azioni, Bologna, Italy

[21] Appl. No.: 34,508

[22] Filed: Mar. 19, 1993

[30] Foreign Application Priority Data

Mar. 20, 1992 [IT] Italy ..... BO92A0098

[51] Int. Cl.[6] ..... B65B 47/06

[52] U.S. Cl. ..... 53/453; 53/559; 53/578

[58] Field of Search ..... 53/228, 453, 466, 559, 53/563, 578, 574

[56] References Cited

U.S. PATENT DOCUMENTS 3,771,282 11/1973 Flanagan ..... 53/578 X
3,941,037 3/1976 Reichert ..... 53/563 X
3,968,623 7/1976 Langen .
3,986,319 10/1976 Puskarz et al. .
4,258,525 3/1981 Focke ..... 53/228
4,308,712 1/1982 Hagedorn ..... 53/574 X

FOREIGN PATENT DOCUMENTS 1238378 4/1967 Germany ..... 53/578
2170171 7/1986 United Kingdom .

*Primary Examiner*—Linda B. Johnson
*Attorney, Agent, or Firm*—Marshall, O'Toole, Gerstein, Murray & Borun

[57] ABSTRACT

A method and machine for producing cartons of cigarettes, each consisting of a number of packets of cigarettes housed inside a box formed from a flat blank divided by yield lines into a number of panels; the carton being formed by feeding the blank along a first path to a prefolding station where the blank is folded substantially in a U, and by transferring the prefolded blank to a loading station where a respective group of packets is fed inside the prefolded blank, and is pushed further, along a further path, so as to feed the blank and respective group of packets into a folding channel for closing the box.

18 Claims, 4 Drawing Sheets

METHOD AND MACHINE FOR PRODUCING CARTONS OF CIGARETTES

BACKGROUND OF THE INVENTION

The present invention relates to a method of producing cartons of cigarettes.

Cartons of cigarettes are produced using precut blanks having a number of lateral and a number of transverse yield lines. The lateral yield lines define on the blanks two large lateral panels separated by a central small lateral panel, and having respective longitudinal tabs, which are superimposed one on top of the other to define a further small lateral panel. The transverse yield lines, on the other hand, define end tabs on the ends of at least some of the aforementioned panels.

According to one known method, the blanks as described above are fed successively to a loading station on the cartoning machine, where the central small lateral panel is positioned closing a folding channel formed in a folding jig and having an inwardly-tapering inlet.

A group of packets of cigarettes constituting the content of the carton is fed to the loading station simultaneously with a respective blank, and is pushed into contact with the central small lateral panel and into the folding channel so as to fold the blank in a U about the group. U-shaped folding of the blank is assisted by prefolding the two large lateral panels about the respective yield lines connecting them to the central small lateral panel, which prefolding operation is normally performed using wedge-shaped prefolding spindles of the same shape as the tapered inlet of the folding channel, and which move together with the group of packets as this is inserted inside the folding channel.

The above known method presents several drawbacks due to the presence of the prefolding spindles, which, in addition to seriously impairing access to a critical area such as the loading station, also have a negative effect on blank folding time, by virtue of the spindle travel involved, which is at least equal to the distance traveled by the packets towards the respective blank.

SUMMARY OF THE INVENTION

It is an object of the present invention to provide a method of producing cartons of cigarettes, designed to overcome the aforementioned drawbacks.

According to the present invention, there is provided a method of producing cartons of cigarettes, each comprising at least one box formed from a flat blank divided by yield lines into an intermediate panel, and a first and second lateral panel on either side of the intermediate panel; the method being characterized by the fact that it comprises stages wherein the flat blanks are fed successively to a prefolding station; each blank is arrested in the prefolding station with said intermediate panel facing the inlet of a folding cavity having a substantially U-shaped cross section; thrust is exerted on, and in a direction substantially perpendicular to, the intermediate panel, so as to insert the blank inside the cavity and fold the two lateral panels in a U about the intermediate panel; the prefolded blank is extracted from the cavity via conveying means; and the prefolded blank is fed along a given path to a loading station where each said blank is paired with a respective group of packets fed to the loading station via first supply means.

The present invention also relates to a machine for producing cartons of cigarettes.

According to the present invention, there is provided a machine for producing cartons of cigarettes, each comprising at least one box formed from a flat blank divided by yield lines into an intermediate panel, and a first and second lateral panel on either side of the intermediate panel; the machine comprising a loading station; and first supply means for successively feeding groups of packets of cigarettes to the loading station, and pairing them with a respective blank; characterized by the fact that it comprises a station for prefolding said blanks; and conveying means for successively transferring the prefolded blanks to said loading station; said prefolding station presenting a folding cavity with a substantially U-shaped cross section, and comprising stop means for arresting each said flat blank with its intermediate panel facing the inlet of said cavity; and push means moving in a thrust direction perpendicular to said intermediate panel, for engaging the intermediate panel and inserting the blank inside the cavity so as to fold the two lateral panels in a U about the intermediate panel; the conveying means cooperating with said prefolding station, for extracting each prefolded blank from said cavity, and feeding it to said loading station along a given path.

According to a preferred embodiment of the machine described above, said conveying means at least partly define a surface of said cavity.

Also, the prefolding and loading stations on the above machine are preferably aligned along said path, which is at least partly defined by said conveying means; said cavity presenting an end surface parallel to said path and perpendicular to said thrust direction.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
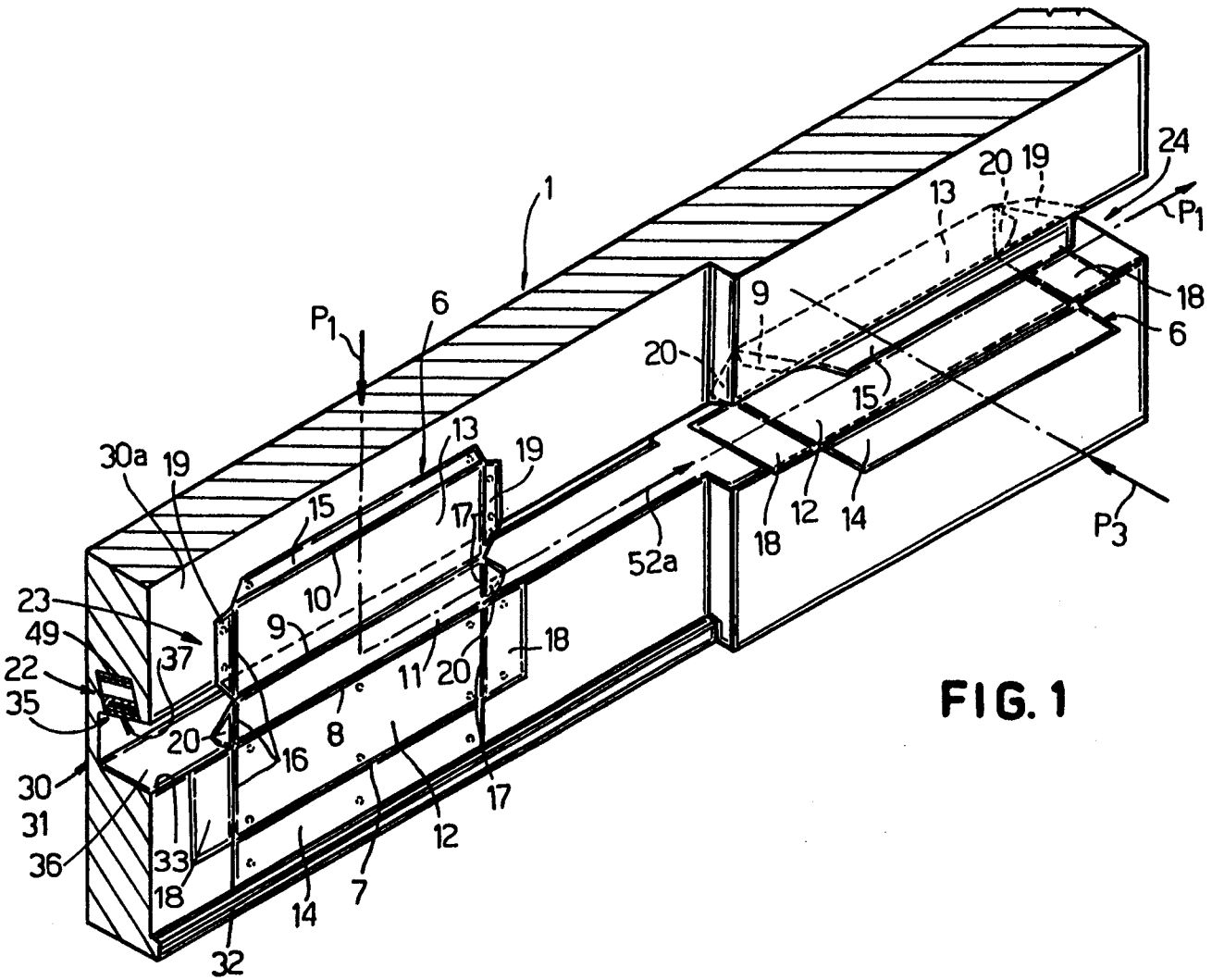
FIG. 1 shows a view in perspective, with parts removed for clarity, of a preferred embodiment of the machine according to the present invention.

Number 1 in the accompanying drawings indicates a cartoning machine for producing cartons 2 of packets of cigarettes 3, each carton comprising a number of packets 3 arranged side by side in two layers 4, and housed inside a single box 5 defined by a known blank 6 of precut sheet material.

With reference to FIG. 1, each blank 6 presents a number of parallel lateral yield lines 7, 8, 9 and 10 defining, on blank 6, an intermediate panel 11 in turn defining a small lateral surface portion of box 5; and a first and second lateral panel 12 and 13 on either side of intermediate panel 11, connected to intermediate panel 11 along respective yield lines 8 and 9, and in turn defining respective large lateral surface portions of box 5. As shown in FIG. 1, yield lines 7 and 10 define a pair of longitudinal tabs 14 and 15 integral with respective lateral panels 12 and 13 along respective yield lines 7 and 10, and which are superimposed one on top of the other to define a further small lateral surface of box 5.

As shown in FIG. 1, each blank 6 also presents a number of transverse yield lines 16 and 17 defining, on blank 6, a pair of first end tabs 18 on either side of and integral with first panel 12 along respective yield lines 16 and 17; a pair of first end tabs 19 on either side of and integral with second panel 13 along respective yield lines 16 and 17; and a pair of second end tabs 20 on either side of intermediate panel 11.

As shown in FIG. 1, machine 1 comprises a transfer unit 22 for successively feeding blanks 6 in steps along a first path P1 and through a blank prefolding station 23, and a loading station 24 where a group 25 defined by said two layers 4 of packets is paired with a respective prefolded blank Machine 1 also comprises a known pocket conveyor belt 26 (FIG. 2) comprising a conveyor belt 27 for successively feeding a number of groups 25 of packets 3 in steps to loading station 24 along a second path P2, the end portion of which extends substantially parallel to the end portion of path P1.

Figure 3:
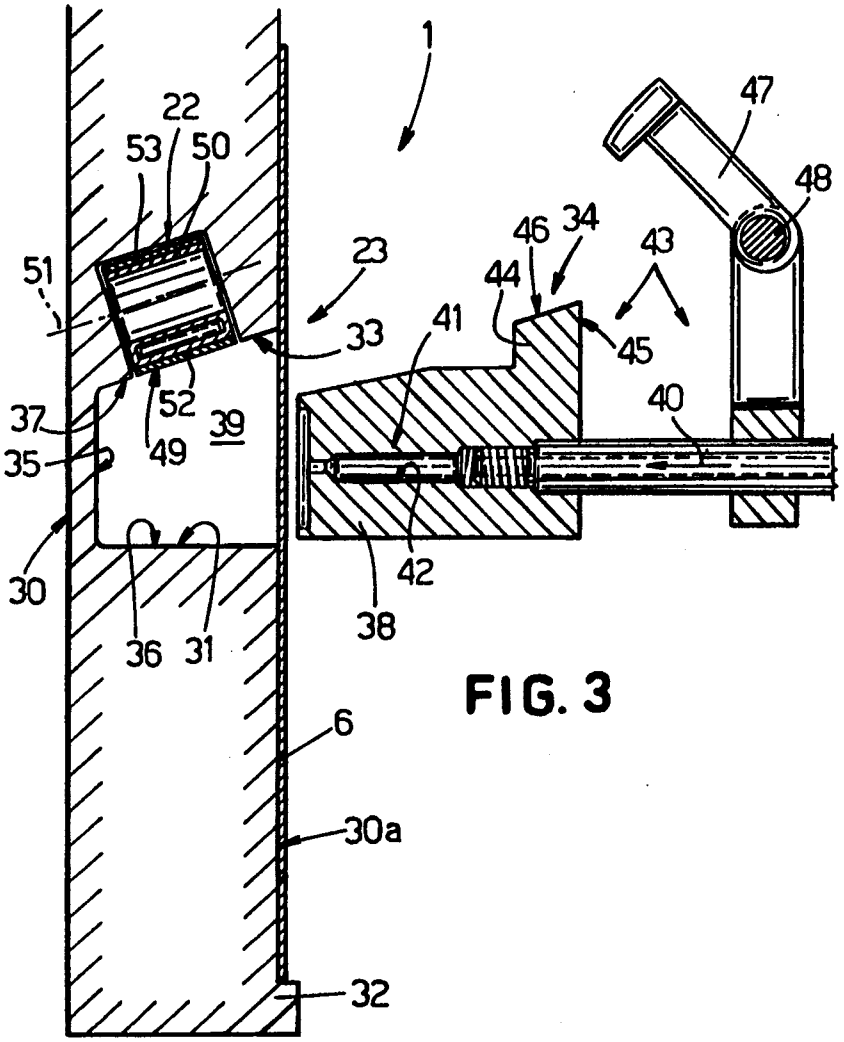
Figure 5:
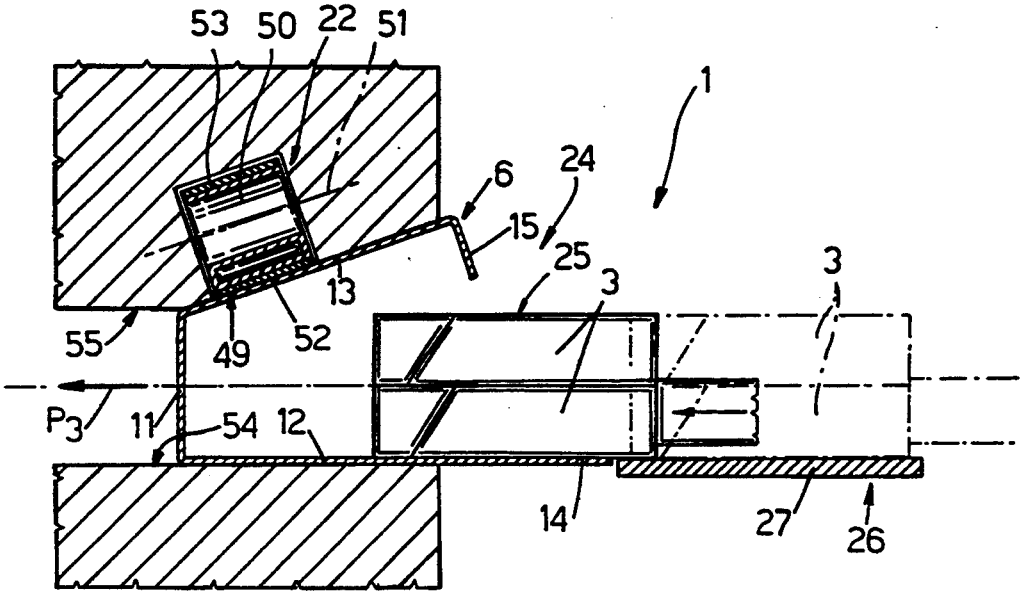
Figure 6:
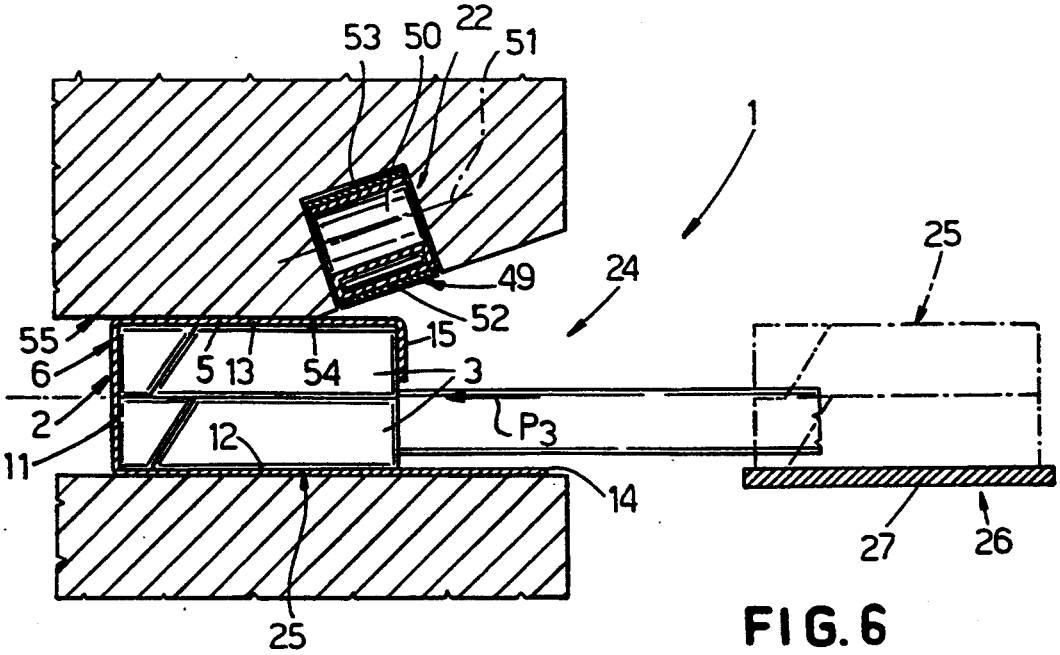

More specifically, and as shown in FIGS. 1 and 3, transfer unit 22 comprises a known, preferably suction type conveyor (not shown) defining the input portion of path P1, and which provides for transferring blanks 6 from a loading station (not shown) to prefolding station 23.

Prefolding station 23 is designed to fold incoming blanks 6 substantially in a U, and comprises a folding jig 30 with an elongated cavity 31 having a substantially horizontal longitudinal axis and a substantially U-shaped cross section, and extending along path P1 with its concavity facing the same. Station 23 also comprises a stop element 32 at one end of the input portion of path P1, and which provides for arresting each flat blank 6 on a flat vertical front surface 30*a* of jig 30, with intermediate panel 11 parallel to the end portion of path P2 and facing inlet 33 of cavity 31 formed through surface 30*a*. Finally, station 23 comprises a folding spindle 34 facing inlet 33 and moving perpendicular to path P1 and to and from a position wherein it engages cavity 31. Cavity 31 presents an end surface 35 parallel to surface 30*a* and perpendicular to the FIG. 3 plane, of the same shape as panel 11, and of a width approximately equal to but no smaller than the width of panel 11. Cavity 31 is also defined by a first flat lateral surface 36 extending from the bottom edge of end surface 35 and perpendicular to surfaces 35 and 30*a*; and by a second oblique lateral surface 37 facing surface 36, and converging towards surface 36 and towards the top edge of end surface 35 with which it forms an obtuse angle.

Figure 4:
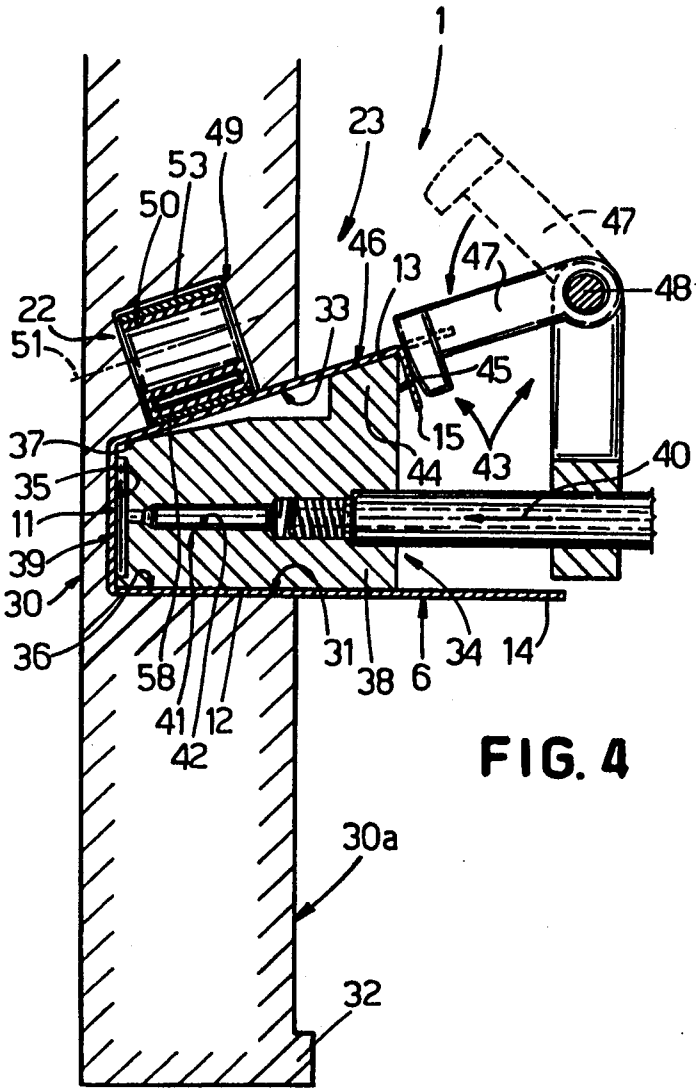
FIGS. 3 to 6 show sections of part of the FIG. 1 machine during a further four operating stages.

As shown in FIG. 3, spindle 34 comprises a folding head 38 for successively engaging flat blanks 6, and having substantially the same cross section as cavity 31. On the side facing cavity 31, head 38 is defined by a flat end surface 39 parallel to surface 35, of the same shape as panel 11, and approximately the same size as but no larger than panel 11. Head 38 is moved, by known actuating means (not shown) and in direction 40 perpendicular to surface 30*a* and panel 11, between a backup position (FIG. 3) wherein surface 39 is positioned facing surface 30*a* and outwards of inlet 33 of cavity 31, and a forward position (FIG. 4) wherein head 38 engages cavity 31, with surface 39 substantially contacting end surface 35.

Head 38 also presents a preferably suction type connecting device 41 designed to cooperate with panel 11 of blank 6 in prefolding station 23, for preventing blank 6 from slipping in relation to head 38 as this is moved into the forward position. More specifically, device 41 comprises a suction channel 42 extending through head 38 and communicating externally through an opening formed through surface 39.

As shown in FIG.3, prefolding station 23 also comprises a further folding unit 43 in turn comprising a locating element 44 on and projecting laterally from head 38 on the surface 37 side. Locating element 44 extends parallel to surface 37 and perpendicular to direction 40, and is defined laterally by a first lateral surface 45 perpendicular to direction 40 and on the opposite side of locating element 44 as compared with folding jig 30; and by a second surface 46 adjacent to surface 45 and forming, with surface 45, an angle substantially complementary to that between surfaces 37 and 35.

Locating element 44 moves with head 38 to and from an operating position (FIG. 4) wherein surface 46 of element 44 is positioned coplanar with surface 37, and surface 45 is separated from surface 35 by a distance, measured parallel to surface 46, approximately equal to but no greater than the width of panel 13.

Folding unit 43 also comprises a folding arm 47 fitted to a drive shaft 48 parallel to path P2, so as to swing about the axis of shaft 48, through the plane defined by surface 37, and along a path substantially tangent to surface 45 when head 38 is in the forward position.

Figure 2:
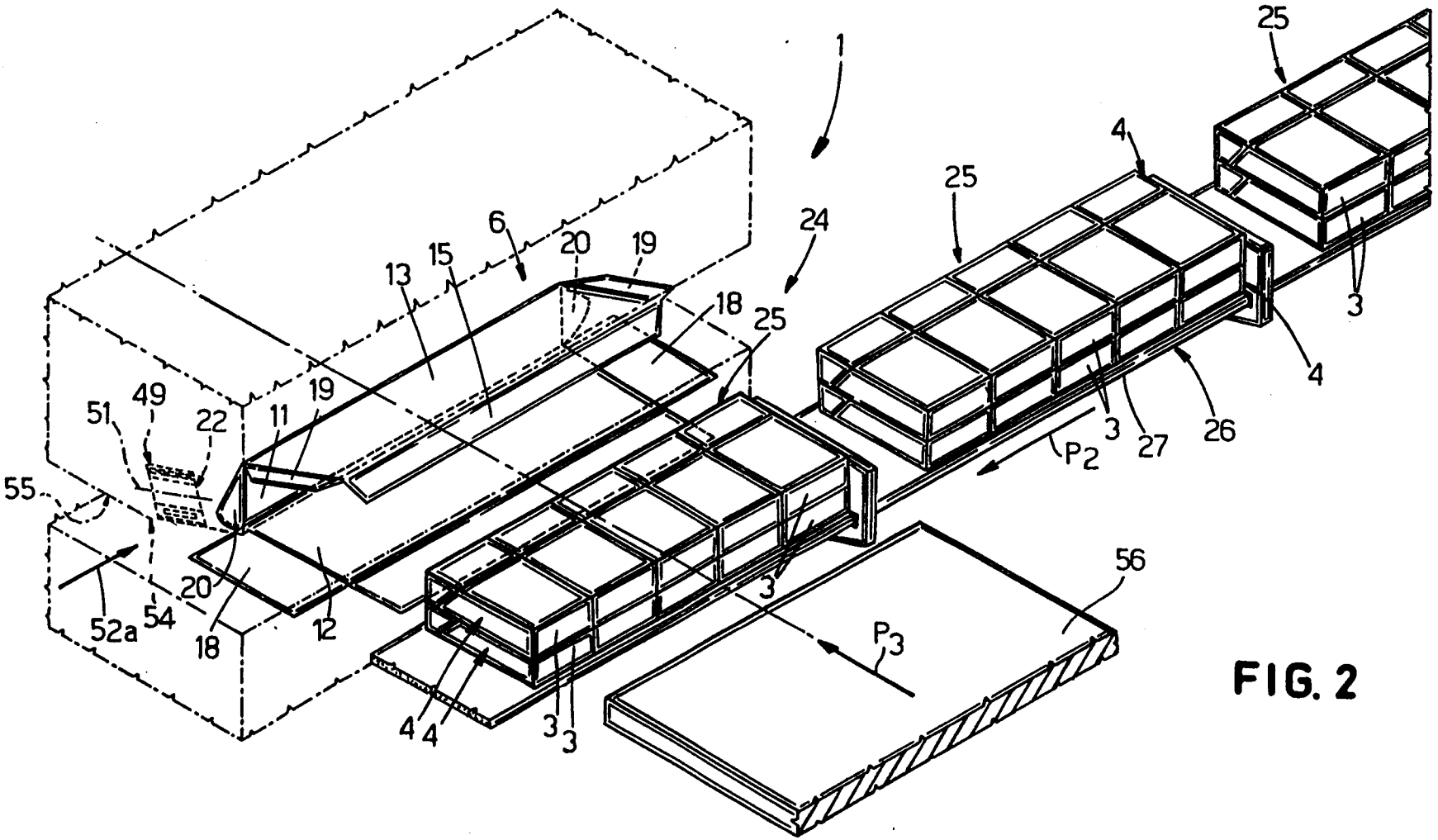
FIG. 2 shows a larger-scale view in perspective of a portion of the FIG. 1 machine during one particular operating stage.

As shown in FIGS. 1 and 2, transfer unit 22 also comprises conveying means 49 consisting of a suction belt looped about two guide rollers 50 (only one shown, and one of which is powered) mounted for rotation about respective axes 51, and which divide belt 49 into a transportation branch 52 (FIG. 3) and a return branch 53. Branch 52 extends along an end portion of path P1, in direction 52*a* substantially perpendicular to direction 40 of head 38, and through prefolding station 23 where the outer surface of branch 52 defines surface 37 of cavity 31. Branch 52 also extends through loading station 24, for transferring prefolded blanks 6 in direction 52*a* from station 23 to station 24, and into a loading position wherein each prefolded blank 6 is positioned with intermediate panel 11 facing the inlet 54 of a known folding channel 55 extending along a path P3 perpendicular to surface 30*a* and direction 52*a*.

Loading station 24 comprises a known pusher 56 on the opposite side of conveyor belt 27 in relation to the inlet 54 of channel 55, and which is moved back and forth along path P3 so as to push each group 25 of packets 3 into contact with intermediate panel 11 of respective prefolded blank 6, and insert group 25 and blank 6 inside channel 55 to finish-fold blank 6 about group 25 in known manner and so form box 5 of carton 2.

With reference to one blank 6 for the sake of simplicity, in actual use said conveyor (not shown) feeds blank 6 into prefolding station 23 where it is arrested by stop element 32 and positioned facing inlet 33 of cavity 31; folding head 38 and locating element 44 are moved forward in direction 40 towards cavity 31, and end surface 39 of head 38 is brought into contact with intermediate panel 11 of blank 6; connecting device 41 is activated for securing and so preventing blank 6 from slipping transversely in relation to head 38; and head 38 and locating element 44 are moved forward further towards cavity 31 so as to insert blank 6 inside cavity 31 and fold lateral panels 12 and 13 in relation to intermediate panel 11 and about respective yield lines 8 and 9. On head 38 moving into the forward position and locating element 44 into the operating position, intermediate panel 11 and first panel 12 extend contacting end surface 35 and lateral surface 36 respectively of cavity 31, while second panel 13 extends contacting both surface 37 of cavity 31 and surface 46 of locating element 44, with respective tab 15 projecting beyond locating element 44.

At this point, shaft 48 fitted with folding arm 47 is rotated anticlockwise (in FIG. 3) so as to fold tab 15 substantially squarely towards head 38; and connecting device 41 is de-activated to release prefolded blank 6, which is then removed from cavity 31 by belt 49 and fed, also by belt 49, to loading station 24 where it is positioned with panel 11 facing inlet 54 of folding channel 55, and with its concavity facing conveyor belt 27 and pusher 56. At the same time prefolded blank 6 is being transferred, a group 25 of packets 3 is fed by conveyor 26 into loading station 24 and into a position between prefolded blank 6 and pusher 56, which then inserts group 25 and respective blank 6 into channel 55 to form finished carton 2 as described above.

To enable group 25 of packets 3 to be inserted inside prefolded blank 6, tab 15 must obviously be so folded that its projection on to the plane of intermediate panel 11 lies outwards of panel 11.

Consequently, at the prefolding stage, second panel 13 need not necessarily be folded obliquely in relation to intermediate panel 11, but may also be folded squarely like first panel 12. In this case, however, tab 15 must necessarily be folded after inserting group 25 of packets 3 inside prefolded blank 6.

Similarly, at the prefolding stage, both lateral panels 12 and 13 may obviously be so folded as to form an obtuse angle with intermediate panel 11; and tab 15 on one of lateral panels 12, 13 may obviously be folded substantially squarely towards the other lateral panel 12, 13 at the prefolding stage.

Belt 49 may also be so positioned that transportation branch 52 defines bottom surface 36 of cavity 31; and suction belt 49 may be replaced by a non-suction type belt with compartments for housing individual blanks 6.

Finally, should market demand require that layers 4 of packets 3 be housed in separate boxes to form two partable half-cartons as described and illustrated in Italian Patent Application N. BO91A 000253 filed on Jul. 16, 1991 and to which full reference is made herein in the interest of full disclosure, machine 1, according to a variation not shown, will comprise two prefolding station 23 located on either side of loading station 24 and each designed to receive, as described above, a respective blank similar to blanks 6. Machine 1 will also comprise two suction belts 49 for transferring prefolded blanks 6 from respective prefolding station 23 to loading station 24.

We claim:

1. A method of producing cartons of cigarettes, each carton comprising at least one box formed from a flat blank divided by yield lines into an intermediate panel, and a first and second lateral panel on either side of the intermediate panel; the method comprising the steps of feeding in succession the flat blanks to a prefolding station;

arresting each blank in the prefolding station with said intermediate panel facing an inlet of a folding cavity having a substantially U-shaped cross section;

exerting a thrust on, in a first direction substantially perpendicular to, the intermediate panel and said inlet, so as to insert the blank inside the cavity and fold the two lateral panels in a U about the intermediate panel to form a prefolded blank;

extracting the prefolded blank from the cavity via conveying means in a second direction substantially perpendicular to said first direction and parallel to said panels inside said cavity;

feeding the prefolded blank by means of said conveying means along a given path to a loading station; and pairing each said blank in the loading station with a respective group of packets fed to the loading station via first supply means.

2. A method as claimed in claim 1, wherein said path extends, at least partly, in said second direction.

3. A method as claimed in claim 1, wherein each said prefolded blank is fed by said conveying means to said loading station with its intermediate panel facing the inlet of a folding channel, and with its concavity facing said first supply means; the first supply means being activated so as to feed said group of packets into contact with the intermediate panel and into the folding channel together with the prefolded blank, so as to close said box.

4. A method as claimed in claim 1, wherein each blank is inserted inside said cavity by push means moving reciprocatingly in said first direction; said thrust means being secured contacting said intermediate panel prior to inserting the blank inside the cavity.

5. A method as claimed in claim 1, further comprising the step of folding squarely at least one of the two lateral panels in relation to the intermediate panel as the relevant blank is inserted inside the cavity.

6. A method as claimed in claim 1, inside the cavity, at least one of the two lateral panels is so folded as to be positioned obliquely in relation to, and to form an obtuse angle with, the intermediate panel.

7. A method as claimed in claim 6, further comprising the step of folding a longitudinal tab on the obliquely positioned panel of the blank squarely in relation to the obliquely positioned panel at the prefolding station; said obtuse angle being such that the projection of said folded longitudinal tab onto the plane of said intermediate panel lies outwards of the intermediate panel.

8. A machine for producing cartons of cigarettes, each comprising at least one box formed from a flat blank divided by yield lines into an intermediate panel, and a first and second lateral panel on either side of the intermediate panel;

said machine comprising a loading station;

first supply means for successively feeding groups of packets of cigarettes to the loading station, and pairing them with a respective blank a station for prefolding said blanks;

conveying means for successively transferring the prefolded blanks to said loading station;

said prefolding station comprising a folding cavity with a substantially U-shaped cross section extending along a longitudinal axis, the folding station comprising stop means for arresting each said flat blank with its intermediate panel facing the inlet of said cavity;

and push means moving in a thrust direction perpendicular to said intermediate panel, for engaging the intermediate panel, and inserting the blank inside the cavity so as to fold the two lateral panels in a U about the intermediate panel to form a prefolded blank;

said conveying means cooperating with said prefolding station, for extracting each prefolded blank from said cavity, and feeding it to said loading station, said extracting and feeding being along a given path in a feed direction substantially perpendicular to said thrust direction and parallel to said axis and said panels inside said cavity.

9. A machine as claimed in claim 8, wherein said path extends, at least partly, in said feed direction

10. A machine as claimed in claim 8, further comprising a folding channel having an inlet at the loading station and designed to successively receive said blanks partially folded about respective said groups of packets, and to finish-fold the blanks for forming respective said boxes;

said conveying means being designed to feed each blank into the loading station with the intermediate panel facing the inlet of said folding channel, and with its concavity facing said first supply means.

11. A machine as claimed in claim 8, wherein said conveying means at least partly define a surface of said cavity.

12. A machine as claimed in claim 8, wherein the prefolding and loading stations are aligned along said path, which is at least partly defined by said conveying means;

said cavity presenting an end surface parallel to said path and perpendicular to said thrust direction.

13. A machine as claimed in claim 12, wherein said cavity is defined by two lateral surfaces on either side of the end surface;

at least one of the two lateral surfaces being substantially perpendicular to the end surface.

14. A machine as claimed in claim 13, wherein said cavity is defined by two lateral surfaces on either side of the end surface;

at least one of the two lateral surfaces being oblique in relation to, and forming an obtuse angle with, the end surface.

15. A machine as claimed in claim 13, wherein said conveying means comprise a suction belt having a transportation branch extending through the prefolding station and the loading station along said path;

said transportation branch at least partly defining one of said two lateral surfaces of said cavity.

16. A machine as claimed in claim 8, wherein said push means are adapted to move in said thrust direction between a first position wherein they extend outside said cavity, and a second position wherein they at least partly engage the cavity;

said push means comprising retaining means for releasably securing said intermediate panel to the push means as the push means are moved, in use, from said first to said second position.

17. A machine as claimed in claim 16, wherein said push means comprise a folding head having an outer shape substantially complementary to that of said cavity;

said head comprising, on the side facing the cavity, a flat surface parallel to the end surface of said cavity;

and said retaining means comprising a suction device communicating externally via said flat surface of said head.

18. A machine as claimed in claim 8, further comprising folding means for folding a tab on one of the two lateral panels of the blank substantially squarely towards the other of the two lateral panels.

* * * * *